US006923516B2

(12) United States Patent
Sheng-Bin

(10) Patent No.: US 6,923,516 B2
(45) Date of Patent: Aug. 2, 2005

(54) CABINET WITH SOFT STORAGE DRAWERS

(75) Inventor: Hsieh Sheng-Bin, GuangDong (CN)

(73) Assignee: Sourcing Solutions, Inc., Hudson, WI (US)

( * ) Notice: Subject to any disclaimer, the term of this patent is extended or adjusted under 35 U.S.C. 154(b) by 40 days.

(21) Appl. No.: 10/633,855

(22) Filed: Aug. 4, 2003

(65) Prior Publication Data

US 2005/0029911 A1 Feb. 10, 2005

(51) Int. Cl.[7] ..... A47B 43/00
(52) U.S. Cl. ..... 312/258
(58) Field of Search ..... 312/257.1, 258, 312/259, 265.5, 3, 4, 5, 6, 330.1; 220/9.2, 220/495.01, 6; 190/107

(56) References Cited

U.S. PATENT DOCUMENTS

| | | | | | |
|---|---|---|---|---|---|
| 3,233,816 | A | * | 2/1966 | Cherrin | 220/495.01 |
| 3,591,245 | A | * | 7/1971 | Allen | 312/258 |
| 3,675,981 | A | * | 7/1972 | Mallander | 312/265.1 |
| 4,290,658 | A | * | 9/1981 | De Rosa | 312/108 |
| 4,316,644 | A | * | 2/1982 | Johnson | 312/108 |
| 4,630,746 | A | | 12/1986 | Fortenberry | |
| 5,285,656 | A | | 2/1994 | Peters | |
| 5,469,999 | A | * | 11/1995 | Phirippidis | 224/542 |
| 5,492,269 | A | | 2/1996 | Sung | |
| 5,931,551 | A | * | 8/1999 | Wang | 312/258 |
| 5,996,882 | A | | 12/1999 | Randall | |
| 6,102,569 | A | | 8/2000 | Wang | |
| 6,116,045 | A | | 9/2000 | Hodosh et al. | |
| 6,149,025 | A | | 11/2000 | Wang | |
| 6,203,198 | B1 | * | 3/2001 | Stone | 383/119 |
| 6,238,091 | B1 | | 5/2001 | Mogil | |
| 6,276,582 | B1 | | 8/2001 | Alexander | |
| 6,305,567 | B1 | * | 10/2001 | Sulpizio | 220/495.11 |
| 6,409,076 | B1 | | 6/2002 | Wang | |
| 6,588,590 | B1 | | 7/2003 | Wang | |

FOREIGN PATENT DOCUMENTS

| | | | | |
|---|---|---|---|---|
| DE | 3940550 | * | 6/1991 | |
| FR | 1053657 | * | 2/1954 | 312/6 |
| GB | 1099582 | * | 1/1968 | 312/258 |

* cited by examiner

*Primary Examiner*—James O. Hansen
(74) *Attorney, Agent, or Firm*—Jansson Shupe & Munger, Ltd.

(57) ABSTRACT

An improved cabinet with drawers having a frame with rigid sides and at least one rigid divider forming a number of drawer-spaces sized to receive erectable/collapsible soft storage drawers. Each drawer is formed from flexible material and has a bottom, two first sidewalls, two second sidewalls, and a top opening. A hard full-wall board is embedded in each of the two first sidewalls and at least one set of two hard half-wall boards is embedded in at least one of the second sidewalls. The two half-wall boards are separated from each other by a folding line. A hard bottom board is seated within the interior of the body of the drawer and is supported by the bottom. Each drawer can be collapsed by moving the bottom board away from the bottom to allow the second sidewalls to be folded inward. Preferably, two half-wall boards are embedded in each second sidewall.

15 Claims, 3 Drawing Sheets

CABINET WITH SOFT STORAGE DRAWERS

FIELD OF THE INVENTION

This invention is related generally to cabinets having drawers and, more particularly, to cabinets having erectable/collapsible drawers made of flexible material.

BACKGROUND OF THE INVENTION

Drawers in conventional cabinets are typically made from wood or metal and are not collapsible. These drawers are heavy and have limited use outside the cabinet. While in some instances these drawers may have been disassembled for shipping, once assembled they cannot be collapsed or disassembled again without great difficulty and oftentimes permanent damage to the drawer.

Certain soft storage drawers and soft storage bins are known in the prior art. Soft storage drawers and bins are containers having a body made from a flexible material such as canvas or leather. Many of them, however, are not collapsible. Those drawers and bins that can be collapsed have complicated structures making it difficult to do so. They require a certain degree of manual dexterity on the part of individuals attempting to fold or flatten them. Others are costly to manufacture or are collapsible only after the supporting framework of the drawer or bin has been disassembled into multiple parts.

Soft storage drawers of simple structure that could be collapsed and later erected into its original shape without extensive assembly would provide numerous benefits to consumers. Their light weight would enable them to be easily carried with their contents to whatever location is desired. When empty, these drawers could be collapsed so as not to take up unnecessary space. Outside the cabinet, the drawers could serve as storage containers or bins that, when filled, could be returned to the cabinet to serve as a convenient repository for the containers.

These soft storage drawers, unlike collapsible containers in the prior art, would furthermore feature stiff sides. Stiff sides are highly desirable since they would enable the drawers to be more durable and thereby have a longer useful life. Stiff sides would also enable the drawer to be self-supporting when erected and would ensure that the drawer maintains the same structure no matter the number of times it has been collapsed and later re-erected.

OBJECTS OF THE INVENTION

It is a primary object of this invention to provide a erectable/collapsible soft storage drawer for use in a cabinet that overcomes some of the problems and shortcomings of the prior art, including those mentioned above.

Another object of this invention is to provide a soft storage drawer for use in a cabinet that can be collapsed and later erected into its original shape.

Another object of this invention is to provide a novel soft storage drawer for use in a cabinet that has an integral body of flexible material and is collapsible along vertical fold lines in its sidewalls.

Another object of the invention is to provide an exceptional soft storage drawer for use in a cabinet that is simple in structure, easy to collapse, and inexpensive to manufacture.

Another object of the invention is to provide an improved erectable/collapsible soft storage bin that has light weight, simple in structure, self-supporting when erected, and durable.

SUMMARY OF THE INVENTION

The invention is an improvement to the type of cabinet having drawers. The improved cabinet has a frame or chest with rigid sides and at least one rigid divider and a plurality of soft storage drawers that are erectable and collapsible. A number of drawer-spaces of specific size are formed from the rigid sides and at least one divider. When erected, the drawers are a size that is substantially complementary to these drawer-spaces.

Each drawer in accordance with this invention includes a body of flexible material having a bottom, two first sidewalls, two second sidewalls, and a top opening. A hard full-wall board is embedded in each of the two first sidewalls and at least one set of two hard half-wall boards is embedded in one of the two second sidewalls. The two half-wall boards of each set are separated from one another by a folding line. The drawer also has a hard bottom board seated inside the drawer so that the board is supported by the fabric bottom. Moving the bottom board away from the bottom enables each drawer to be collapsed through the inward folding of the two second sidewalls.

Preferred embodiments of this invention find each first sidewall having a length greater than the length of either second sidewall. In certain desired embodiments, the drawer has a set of two hard half-wall boards embedded in each of the second sidewalls. Most preferred is where the folding line in each second sidewall embedded with half-wall boards is orthogonal, i.e. perpendicular, to the bottom edge of the second sidewall. Furthermore, it is highly preferred where this folding line is not only perpendicular to but bisects the second sidewall's bottom edge.

In certain preferred embodiments, the first sidewalls are opposite and substantially identical or congruent to each other. This is true for the second sidewalls as well. More desirable is where each sidewall is orthogonal to the bottom. It is highly preferred that all four sidewalls form a rectangular top edge that rests in a substantially horizontal plane.

A most preferred embodiment is where each first sidewall includes a full-wall pocket to receive the full-wall board embedded within the sidewall. In addition, these embodiments have each second sidewall forming a pair of half-wall pockets in which the two half-wall boards can be inserted. Also desirable are embodiments where each drawer includes a handle on at least one of the sidewalls. In certain preferred forms, the bottom board is removable from the interior of the body of the drawer.

Highly desired are embodiments where each sidewall is attached to each adjacent sidewall along their common vertical edge and to the bottom along the sidewall's bottom edge so that the drawer comprises an integral body of flexible material. The term "integral" as used herein refers to the state of completeness in the construction of the body of the drawer from flexible material, i.e. a continuous piece of material with or without seams, such that no further assembly or addition is needed to form the body of the drawer.

In another aspect of this invention, the cabinet comprises a frame that can receive a number of erectable/collapsible soft storage drawers where each drawer includes: (1) a body of flexible material having a bottom, two first sidewalls, two second sidewalls, and a top opening; (2) at least one hard full-wall end board embedded in at least one of the first sidewalls; (3) one set of two hard half-wall boards embedded in each of the two second sidewalls, each pair of half-wall side boards being separated by a folding line; and (4) a hard bottom board seated within the interior of the bin and supported by its bottom. The drawer is capable of being collapsed substantially flat with movement of the bottom board away from the bottom whereby the second sidewalls can be folded inward.

A preferred embodiment of this aspect of the invention is where the folding line in each second sidewall is perpendicular to the bottom edge of the sidewall at its midpoint. More preferred embodiments are where the first sidewalls are opposed and substantially identical to each other, the second sidewalls are also opposed and substantially identical to each other, each sidewall is orthogonal to the bottom, and the sidewalls form a rectangular top edge to the body of the bin that is substantially horizontal.

Highly desirable embodiments find both first sidewalls embedded with a hard full-wall board. In certain preferred cases, the length of each first sidewall is greater than the length of either second sidewall.

In another aspect of this invention, an improved cabinet is achieved where the cabinet is of the type having at least one drawer-space sized to receive a drawer. The improvement is where the drawer is an erectable/collapsible soft storage bin. The drawer comprises: (1) a body of flexible material having a bottom, two opposed and substantially identical first sidewalls, two opposed and substantially identical second sidewalls, and a top opening; (2) a hard full-wall end board embedded in each of the two first sidewalls; (3) a set of two hard half-wall boards embedded in each of the two second sidewalls, each pair of half-wall side boards being separated by a substantially vertical folding line; and (4) a hard bottom board seated within the interior of the drawer and supported by its bottom. In this improved cabinet, the drawer can be collapsed by removing the bottom board to allow the second sidewalls to be folded inward.

In certain preferred embodiments of this aspect of the invention, each sidewall is orthogonal to the bottom and the first and second sidewalls form a rectangular top edge to the body of the drawer that is substantially horizontal. It is highly desirable that the sidewalls and bottom be attached to each other so as to form an integral body.

DETAILED DESCRIPTION OF PREFERRED EMBODIMENTS

Figure 1:
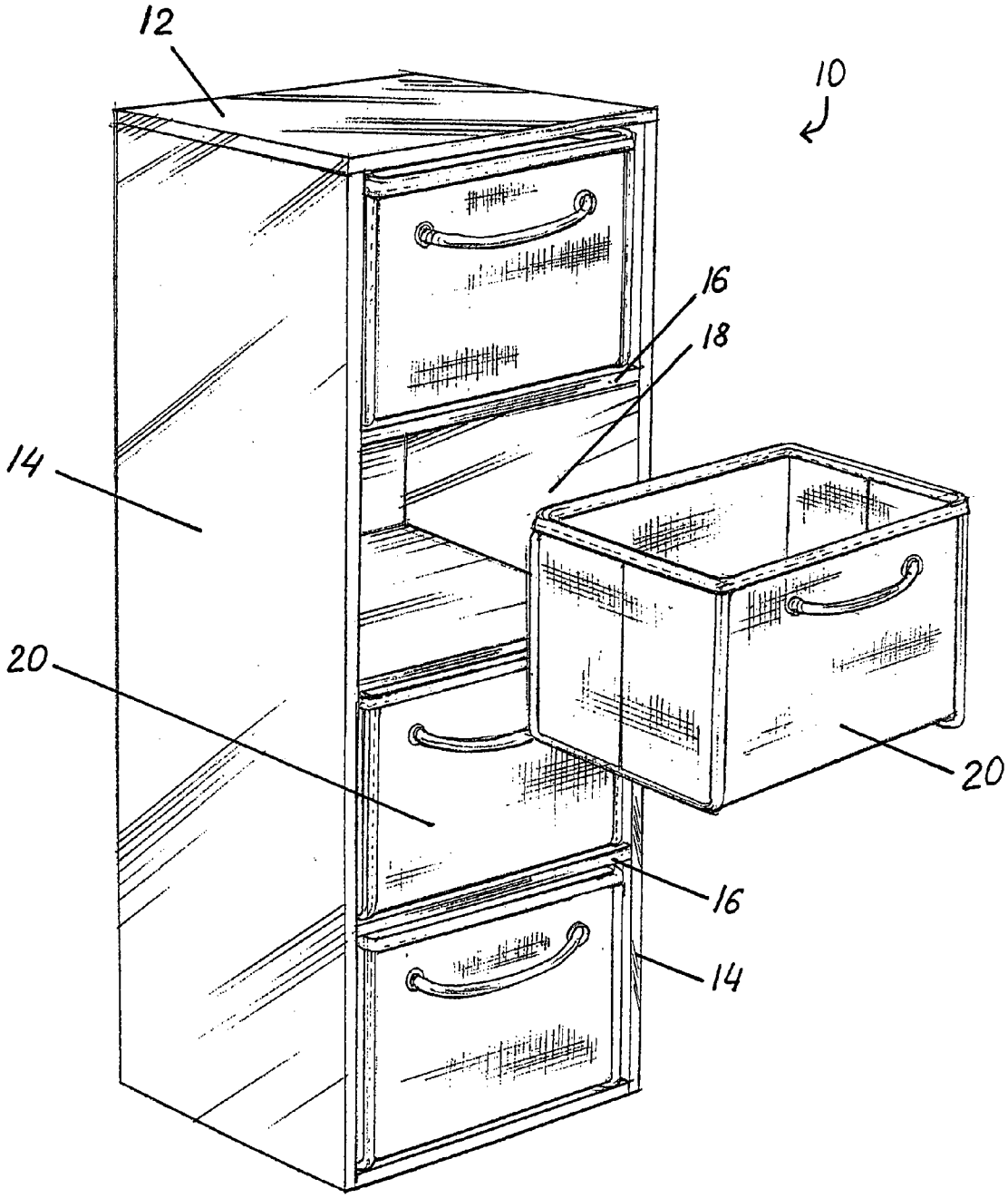
FIG. 1 is a perspective view of a cabinet with soft storage drawers in accordance with this invention.

The drawings illustrate an improved cabinet of drawers 10 in accordance with this invention. As seen in FIG. 1, cabinet 10 is comprised of a frame 12 having rigid sides 14 and rigid dividers 16. These parts can be fabricated using a variety of materials and a variety of assembly procedures known to those skilled in the art.

The sides 14 and dividers 16 form a series of substantially identical drawer-spaces 18. Frame 12 can be constructed to allow for a vertical set of drawer-spaces 18 as shown in FIG. 1. Frame 12 can also have the drawer-spaces 18 positioned either horizontally or forming a combination of vertical and horizontal shelving.

Cabinet 10 is further provided with soft storage drawers 20 that can be easily erected and collapsed. When erected each drawer 20 is sized so that it can be slideably received within an individual drawer-space 18.

Drawer 20 is comprised of a body 22 formed from flexible material. Such flexible materials range from woven fabrics such as canvas to such non-woven substances as leather, polypropylene, and polyvinyl chloride. Body 22 need not be formed from a single material but can, for example, have an outer wall of canvas and an inner wall of polypropylene for ease in cleaning. Other useful combinations will be apparent to those skilled in the art.

Figure 2:
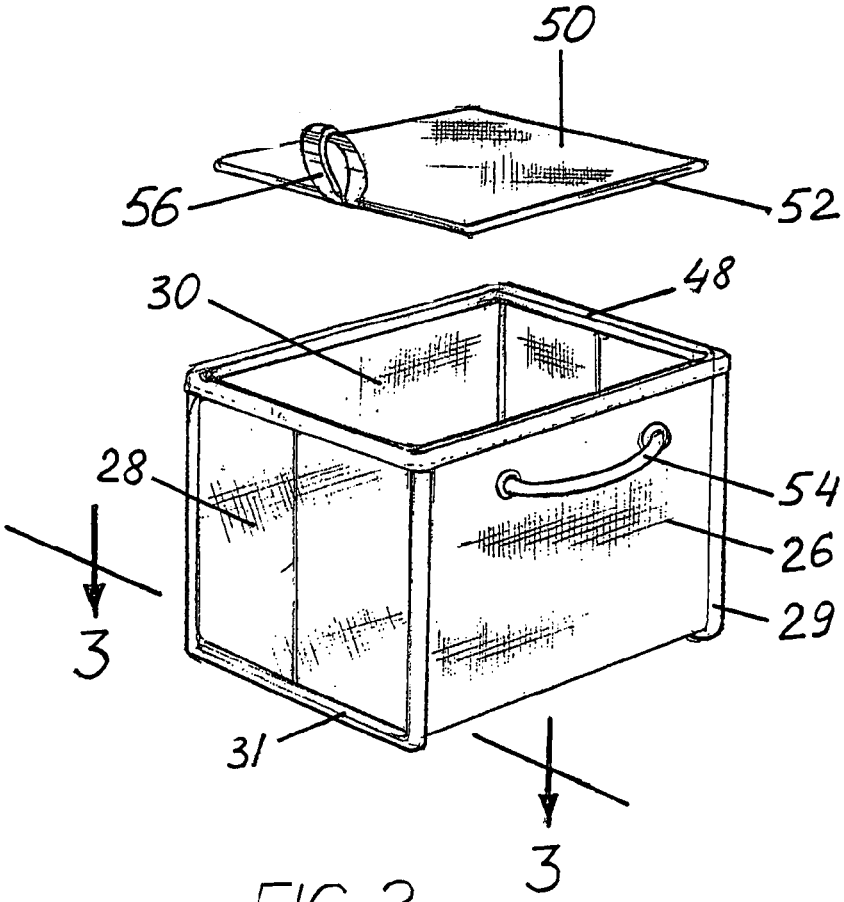
FIG. 2 is an exploded view of the drawer in FIG. 1.
Figure 3:
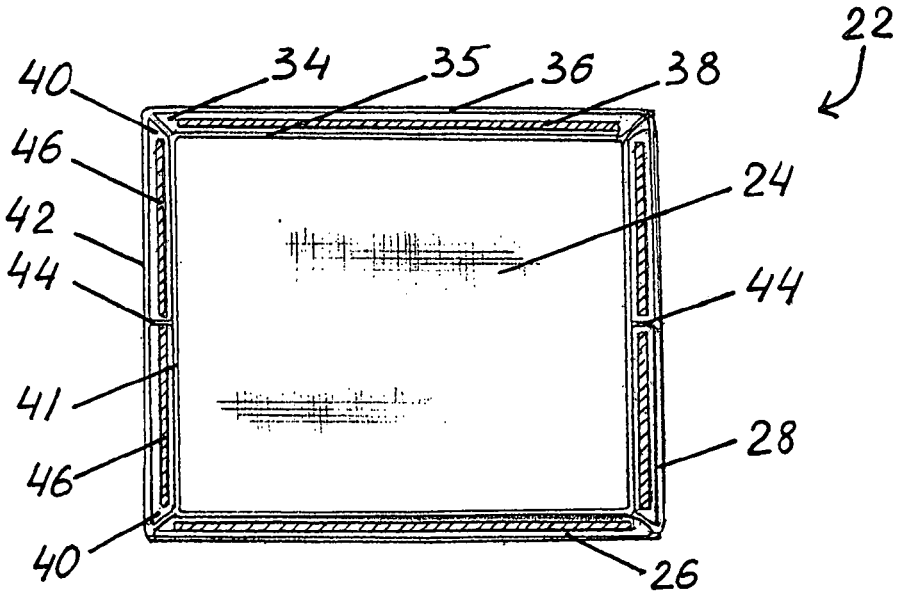
FIG. 3 is a top sectional view of the drawer along section line 3—3 in FIG. 2.

As illustrated in FIGS. 2–3, body 22 has a bottom 24, two first sidewalls 26, and two second sidewalls 28. Each sidewall 26, 28 is permanently joined to the two adjacent sidewalls along both of its vertical edges 29 to form a contiguous peripheral ring. Each sidewall 26, 28 is also permanently attached to bottom 24 along bottom edge 31.

The union between sidewalls 26, 28 along vertical edges 29 and between sidewalls 26, 28 and bottom 24 along bottom edges 31 establishes a body 22 that is integral. Attachment of sidewall 26 with sidewall 28 or of sidewall 26, 28 with bottom 24 is achieved either by using the same material for both portions or by joining two separate pieces of material together as with stitches or adhesive in a manner known to those skilled in the art. This joins adjacent portions without restricting movement along edges 29, 31.

First sidewalls 26 are situated opposite from each other within body 22. First sidewalls 26 are substantially vertical, i.e. perpendicular or orthogonal to bottom 24, and substantially equivalent in size and shape. Each first sidewall 26 has a full-wall pocket 34. Full-wall pocket 34 is formed from first inner-wall 35 and first outer-wall 36 being joined along vertical edges 29 and bottom edge 31. Full-wall pocket 34 is sized to receive a hard full-wall board 38. Each full-wall board 38 is preferably thin with a height and width slightly less than the corresponding dimensions of the receiving full-wall pocket 34.

Second sidewalls 28 are likewise opposite each other, substantially vertical, and substantially congruent. Each second sidewall 28 has two half-wall pockets 40. Both half-wall pockets 40 are formed from second inner-wall 41 and second outer-wall 42 being attached along vertical edges 29 and bottom edge 31. Each half-wall pocket 40 is separated from the other by a folding line 44 formed by joining second inner-wall 41 to second outer-wall 42 along line 44 between top edge 48 and bottom edge 31. Folding line 44 is vertical, i.e. orthogonal to bottom edge 31, and mid-point between adjacent vertical edges 29. Each half wall pocket 40 is sized to receive a half wall board 46. Similar to full-wall board 38, each half-wall board 46 is preferably thin with a height and width slightly less than the respective dimensions for the corresponding half-wall pocket 40.

After a full-wall board 38 has been embedded within the full-wall pocket 34 of each first sidewall 26, full-wall board 38 is secured within full-wall pocket 34 by joining first inner-wall 35 to first outer-wall 36 along top edge 48. In a similar manner, each half-wall board 46 is secured within its corresponding half-wall pocket 40 by joining second inner-wall 41 to second outer-wall 42 along top edge 48 of the respective second sidewall 28.

Figure 4:
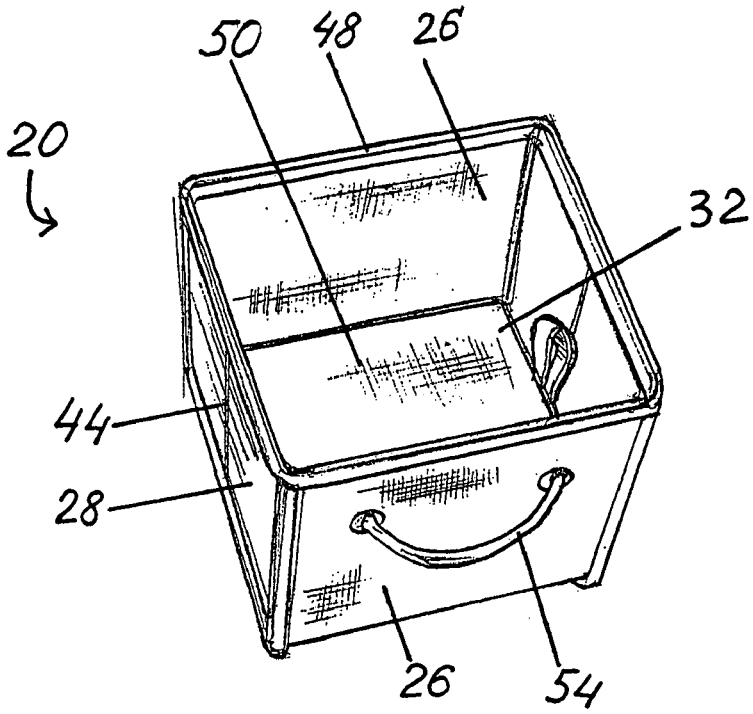
FIG. 4 is a perspective view of the drawer in FIG. 1.

Body 22 has a top opening 30 formed by top edges 48 that provides access to the interior 32 of the drawer 20. As seen in FIG. 4, a hard bottom board 50 is placed within interior 32 to rest upon bottom 24. Bottom board 50 is preferably covered in the same material as comprising body 22. Bottom board 50 is sized so as to allow its side edges 52 to frictionally contact inner walls 35, 41 of each sidewall 26, 28.

Figure 5:
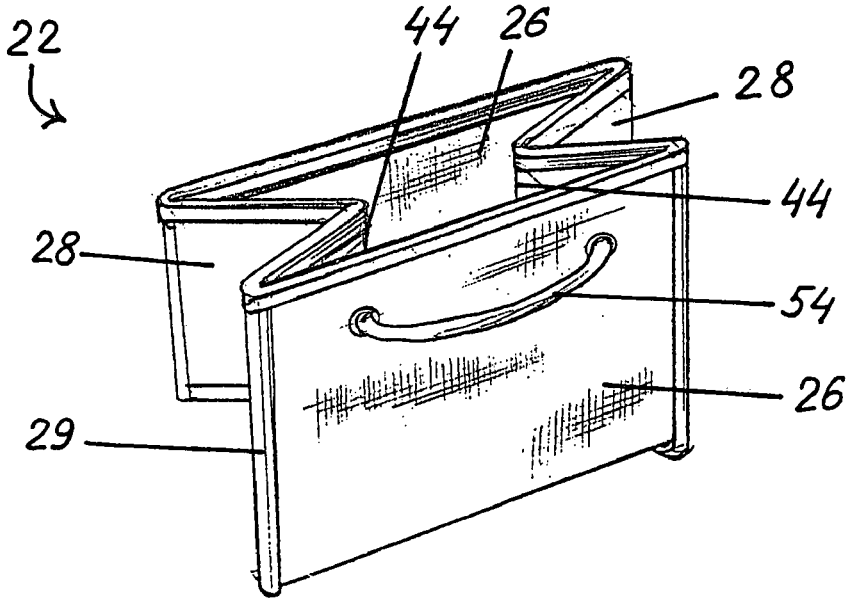
FIG. 5 is a perspective view of the drawer in FIG. 4 being collapsed after the bottom board has been removed.

When drawer 20 is erected, bottom board 50 maintains each sidewall 26, 28 in an upright orientation. Pivoting bottom board 50 or removing it entirely from interior 32 so that bottom board 50 no longer rests upon bottom 24 allows second sidewalls 28 to fold inward along folding line 44 as illustrated in FIG. 5. Drawer 20 can be collapsed into a substantially flat configuration by permitting each second sidewall 28 to fold in half in this manner. Loop 56 is attached to bottom board 50 as an aid when inserting and removing bottom board 50 into and from body 22.

Each full-wall board 38 and each pair of half-wall boards 46 provide reinforcement to sidewalls 26, 28. This reinforcement allows the flexible material of sidewalls 26, 28 to stand upright when drawer 20 is erected. Boards 38, 46 also give sidewalls 26, 28 the rigidity needed to increase the durability and the useful life of drawer 20. Moreover, such rigidity insures that drawer 20 returns substantially to its original shape despite being repeatedly collapsed and then re-erected. Boards 38, 46 are preferably made from cardboard but even particle board or sheet metal can be used.

As shown in FIGS. 1–2, 4–5, drawer 20 is provided with a handle-strap 54 secured to one of first sidewalls 26 to serve as a handle. A handle to be used with drawer 20 can be provided in a number of other ways understandable to those skilled in the art. Handle-strap 54 permits drawer 20 to easily slide in and out of its respective drawer space 18 in cabinet 10. Handle-strap 54 alone or in combination with another handle-strap on the opposite first sidewall 26 also helps as a handgrip when drawer 20 is serving as a soft storage bin.

While the principles of the invention have been shown and described in connection with specific embodiments, it is to be understood that such embodiments are by way of example and are not limiting.

What is claimed is:

1. A cabinet of drawers comprising:

a frame having rigid sides and at least one rigid divider, the at least one divider forming with the rigid sides a plurality of drawer-spaces of fixed dimensions;

a plurality of erectable/collapsible soft storage drawers dimensioned when erected to be substantially complementary to the drawer-spaces, each drawer including:

a body of flaccid material, the body having a bottom, two first sidewalls, two second sidewalls, and a top opening defining an interior, each of the bottom and sidewalls having no predetermined shape;

each first sidewall forming a full-wall pocket to receive one hard full-wall board embedded therein;

at least one second sidewall having a substantially vertical folding-seam forming two half-wall pockets, each half-wall pocket receiving one hard half-wall board embedded therein, and abutting one full-wall pocket along a vertical edge; and a hard bottom board seated within the interior and supported by the bottom, wherein moving the bottom board away from the bottom enables each drawer to be collapsed.

2. The cabinet of claim 1 wherein each sidewall has a length and the length of each first sidewall is greater than the length of either second sidewall.

3. The cabinet of claim 2 wherein each second sidewall has a substantially vertical folding-seam forming two half-wall pockets, each half-wall pocket receiving one hard half-wall board embedded therein, and abutting one full-wall pocket along a vertical edge.

4. The cabinet of claim 3 wherein each second sidewall has a bottom edge adjacent to the bottom, the folding-seam being orthogonal at the midpoint of the bottom edge.

5. The cabinet of claim 4 wherein the body has two opposed and substantially identical first sidewalls and two opposed and substantially identical second sidewalls.

6. The cabinet of claim 5 wherein each sidewall is orthogonal to the bottom.

7. The cabinet of claim 4 wherein the body has a rectangular top edge in a substantially horizontal plane.

8. The cabinet of claim 1 wherein each sidewall is attached with respect to each adjacent sidewall along a vertical edge and each sidewall is attached with respect to the bottom along a bottom edge whereby the drawer has an integral body of flexible material.

9. The cabinet of claim 1 wherein each drawer further comprises a handle on at least one sidewall.

10. The cabinet of claim 1 wherein the bottom board is removable from the interior of the body.

11. A cabinet of drawers comprising:

a frame having rigid sides and at least one rigid divider, the at least one divider forming with the rigid sides a plurality of drawer-spaces of fixed dimensions;

a plurality of erectable/collapsible soft storage drawers dimensioned when erected to be substantially complementary to the drawer-spaces, each drawer including:

a body of flaccid material, the body having a bottom, two first sidewalls, two second sidewalls, and a top opening defining an interior;

one hard full-wall board embedded in at least one of the first sidewalls;

one set of two hard half-wall boards embedded in each of the second sidewalls, the two half-wall boards of each set being separated from one another by a folding-seam in the body; and a hard bottom board seated within the interior and supported by the bottom, wherein moving the bottom board away from the bottom enables each drawer to be collapsed.

12. The cabinet of claim 11 wherein each second sidewall has a bottom edge adjacent to the bottom, the folding-seam being orthogonal at the midpoint of the bottom edge.

13. The cabinet of claim 12 wherein:

the body has two opposed and substantially identical first sidewalls and two opposed and substantially identical second sidewalls;

each sidewall is orthogonal to the bottom; and the body has a rectangular top edge in a substantially horizontal plane.

14. The cabinet of claim 13 wherein a hard full-wall board is embedded in each of the first sidewalls.

15. The cabinet of claim 14 wherein each sidewall has a length and the length of each first sidewall is greater than the length of either second sidewall.

* * * * *